US008344962B2

(12) United States Patent
Hui et al.

(10) Patent No.: US 8,344,962 B2
(45) Date of Patent: Jan. 1, 2013

(54) APPARATUS, METHOD AND COMPUTER PROGRAM FOR WIRELESS COMMUNICATION

(75) Inventors: Ping Hui, British Columbia (CA); Rong Bang An, Beijing (CN); Shu Liu, Beijing (CN); Wanbo Xie, Beijing (CN)

(73) Assignee: Nokia Corporation, Espoo (FI)

( * ) Notice: Subject to any disclaimer, the term of this patent is extended or adjusted under 35 U.S.C. 154(b) by 845 days.

(21) Appl. No.: 12/313,405

(22) Filed: Nov. 20, 2008

(65) Prior Publication Data

US 2010/0123640 A1 May 20, 2010

(51) Int. Cl.
*H01Q 1/48* (2006.01)

(52) U.S. Cl. ..... 343/848

(58) Field of Classification Search ..... 343/849, 343/746, 750, 861, 868, 848
See application file for complete search history.

(56) References Cited

U.S. PATENT DOCUMENTS

| | | | | |
|---|---|---|---|---|
| 6,650,295 | B2 * | 11/2003 | Ollikainen et al. | 343/700 MS |
| 6,700,540 | B2 * | 3/2004 | Holshouser | 343/700 MS |
| 7,277,058 | B2 * | 10/2007 | Faraone et al. | 343/702 |
| 7,330,156 | B2 * | 2/2008 | Arkko et al. | 343/702 |
| 7,479,927 | B2 * | 1/2009 | Scarpelli | 343/702 |
| 7,623,072 | B2 * | 11/2009 | Feng et al. | 343/700 MS |
| 7,633,449 | B2 * | 12/2009 | Oh et al. | 343/702 |
| 7,728,779 | B2 * | 6/2010 | Korner | 343/702 |
| 7,808,433 | B2 * | 10/2010 | Rutfors et al. | 343/700 MS |
| 7,817,094 | B2 * | 10/2010 | Adachi et al. | 343/702 |
| 2003/0142022 | A1 | 7/2003 | Ollikainen et al. | |
| 2005/0159195 | A1 | 7/2005 | Huber et al. | |
| 2008/0001831 | A1 | 1/2008 | Park et al. | |
| 2008/0231521 | A1 | 9/2008 | Anguera Pros et al. | |
| 2010/0245183 | A1 * | 9/2010 | Hyvonen et al. | 343/702 |

FOREIGN PATENT DOCUMENTS

| | | | |
|---|---|---|---|
| CN | 1481183 | | 3/2004 |
| EP | 1368856 | | 12/2003 |
| EP | 401050 | A1 | 3/2004 |
| EP | 1562259 | A1 | 8/2005 |
| JP | 2001274719 | A | 10/2001 |
| SE | 528327 | | 10/2006 |
| WO | WO 03/067702 | | 8/2003 |
| WO | WO 2007/043941 | | 4/2007 |
| WO | WO 2008/084273 | | 7/2008 |
| WO | WO 2008/120038 | A1 | 10/2008 |

* cited by examiner

*Primary Examiner* — Huedung Mancuso
(74) *Attorney, Agent, or Firm* — Harrington & Smith

(57) ABSTRACT

An apparatus comprising: a ground plane configured to receive an antenna, operable in a first resonant frequency band, at a first end of the ground plane; and a member configured to electromagnetically couple with the antenna, provide the ground plane with an electrical dimension, in combination with the antenna, having a resonant mode at the first resonant frequency band, and to reduce current distribution at a second end of the ground plane, different to the first end.

28 Claims, 7 Drawing Sheets

APPARATUS, METHOD AND COMPUTER PROGRAM FOR WIRELESS COMMUNICATION

FIELD OF THE INVENTION

Embodiments of the present invention relate to an apparatus, method and computer program for wireless communication. In particular, they relate to an apparatus, method and computer program in a portable electronic device.

BACKGROUND TO THE INVENTION

Apparatus, such as portable electronic devices usually include one or more antennas for wireless communication with other such apparatus. The antennas are usually arranged to receive an encoded radio frequency (RF) signal from a transceiver and transmit the signal to another apparatus. Similarly, the antennas are usually arranged to be able to receive an encoded radio frequency signal from another apparatus and provide the signal to a transceiver for decoding.

When in operation, the radio frequency signals emitted by the apparatus may affect other electronic apparatus which are positioned in relatively close proximity (for example, within ten centimeters) to the apparatus, i.e. the 'near field' of the apparatus may affect other electronic apparatus. For example, when the apparatus is a mobile cellular telephone, the 'near field' from the telephone may affect the operation of a user's hearing aid when the user is making a telephone call.

It would therefore be desirable to provide an alternative apparatus.

BRIEF DESCRIPTION OF VARIOUS EMBODIMENTS OF THE INVENTION

According to various, but not necessarily all, embodiments of the invention there is provided an apparatus comprising: a ground plane configured to receive an antenna operable in a first resonant frequency band, at a first end of the ground plane; and a member configured to electromagnetically couple with the antenna, provide the ground plane with an electrical dimension, in combination with the antenna, having a resonant mode at the first resonant frequency band, and to reduce current distribution at a second end of the ground plane, different to the first end.

The apparatus may be for wireless communications.

The member may be configured to reduce current distribution at the second end of the ground plane relative to an apparatus that does not comprise the member.

The electrical dimension of the ground plane may be electrical width.

The member may be positioned at the first end of the ground plane. The member may be integral with the ground plane. The member may be for connecting to the ground plane.

The first end of the ground plane may be opposite to the second end of the ground plane.

The member may comprise an elongate conductive portion. The elongate conductive portion may be configured to extend from the ground plane toward a feed point of the antenna. An open end of the elongate conductive portion may be configured to be in relatively close proximity to the feed point of the antenna.

The member may be configured to be substantially parallel to the antenna.

The member may be configured to be variable. The member may be configured to provide the ground plane with an electrical dimension, in combination with the antenna, selectable from a plurality of electrical dimensions.

The apparatus may further comprise a processor configured to control the member and may be configured to select the electrical dimension of the ground plane.

The apparatus may further comprise an audio output. The audio output may be positioned at the second end of the ground plane. The audio output may be configured to provide audio signals to a user of the apparatus.

The member may be configured to provide the ground plane with another electrical dimension, in combination with the antenna, having a resonant mode at a second resonant frequency band, different to the first resonant frequency band. The resonant mode at the second resonant frequency band may be a common mode.

According to various, but not necessarily all, embodiments of the invention there is provided a portable electronic device comprising an apparatus as described in any of the preceding paragraphs.

According to various, but not necessarily all, embodiments of the invention there is provided a module comprising as apparatus as described in any of the preceding paragraphs.

According to various, but not necessarily all, embodiments of the invention there is provided a method comprising: providing a ground plane configured to receive an antenna operable in a first resonant frequency band, at a first end of the ground plane, and a member; and configuring the member to electromagnetically couple with the antenna, provide the ground plane with an electrical dimension, in combination with the antenna, having a resonant mode at the first resonant frequency band, and to reduce current distribution at a second end of the ground plane, different to the first end.

The method may further comprise positioning the member at the first end of the ground plane. The first end of the ground plane may be opposite to the second end of the ground plane. The member may comprise an elongate conductive portion. The method may include configuring the elongate conductive portion to extend from the ground plane toward a feed point of the antenna. The method may include configuring an open end of the elongate conductive portion to be in relatively close proximity to the feed point of the antenna.

The method may further comprise configuring the member to be substantially parallel to the antenna.

The method may further comprise configuring the member to be variable and to provide the ground plane with an electrical dimension, in combination with the antenna, selectable from a plurality of electrical dimensions.

The method may further comprise providing a processor. The method may further comprise configuring the processor to control the member and to select the electrical dimension of the ground plane.

The method may further comprise providing an audio output, positioned at the second end of the ground plane. The method may further comprise configuring the audio output to provide audio signals to a user of the apparatus.

The method may further comprise configuring the member to provide the ground plane with another electrical dimension, in combination with the antenna, having a resonant mode at a second resonant frequency band, different to the first resonant frequency band. The resonant mode at the second resonant frequency band may be a common mode.

According to various, but not necessarily all, embodiments of the invention there is provided a computer program that, when run on a computer, performs: controlling a member to provide a ground plane, in combination with an antenna, with an electrical dimension, selectable from a plurality of electrical dimensions, having a resonant mode at a first resonant frequency band, and to reduce current distribution at a second end of the ground plane, wherein the member is configured to electromagnetically couple with the antenna and the antenna is positioned at a first end of the ground plane, different to the second end of the ground plane and is operable in the first resonant frequency band.

The computer program may, when run on a computer, further perform determining if a change in the electrical dimension of the ground plane, member, and antenna combination is required, and controlling the member if a change in the electrical dimension is required.

According to various, but not necessarily all, embodiments of the invention there is provided a computer readable storage medium encoded with instructions that, when executed by a processor, performs: controlling a member to provide a ground plane, in combination with an antenna, with an electrical dimension, selectable from a plurality of electrical dimensions, having a resonant mode at a first resonant frequency band, and to reduce current distribution at a second end of the ground plane, wherein the member is configured to electromagnetically couple with the antenna and the antenna is positioned at first end of the ground plane, different to the second end of the ground plane and is operable in the first resonant frequency band.

The computer readable storage medium may be encoded with instructions that, when executed by a processor, perform: determining if a change in the electrical dimension of the ground plane, member, and antenna combination is required, and controlling the member if a change in the electrical dimension is required.

According to various, but not necessarily all, embodiments of the present invention there is provided a method comprising: controlling a member to provide a ground plane, in combination with an antenna, with an electrical dimension, selectable from a plurality of electrical dimensions, having a resonant mode at a first resonant frequency band, and to reduce current distribution at a second end of the ground plane, wherein the member is configured to electromagnetically couple with the antenna and the antenna is positioned at first end of the ground plane, different to the second end of the ground plane and is operable in the first resonant frequency band.

The method may further comprise: determining if a change in the electrical dimension of the ground plane, member, and antenna combination is required, and controlling the member if a change in the electrical dimension is required.

BRIEF DESCRIPTION OF THE DRAWINGS

For a better understanding of various examples of embodiments of the present invention reference will now be made by way of example only to the accompanying drawings in which.

DETAILED DESCRIPTION OF VARIOUS EMBODIMENTS OF THE INVENTION

Figure 2:
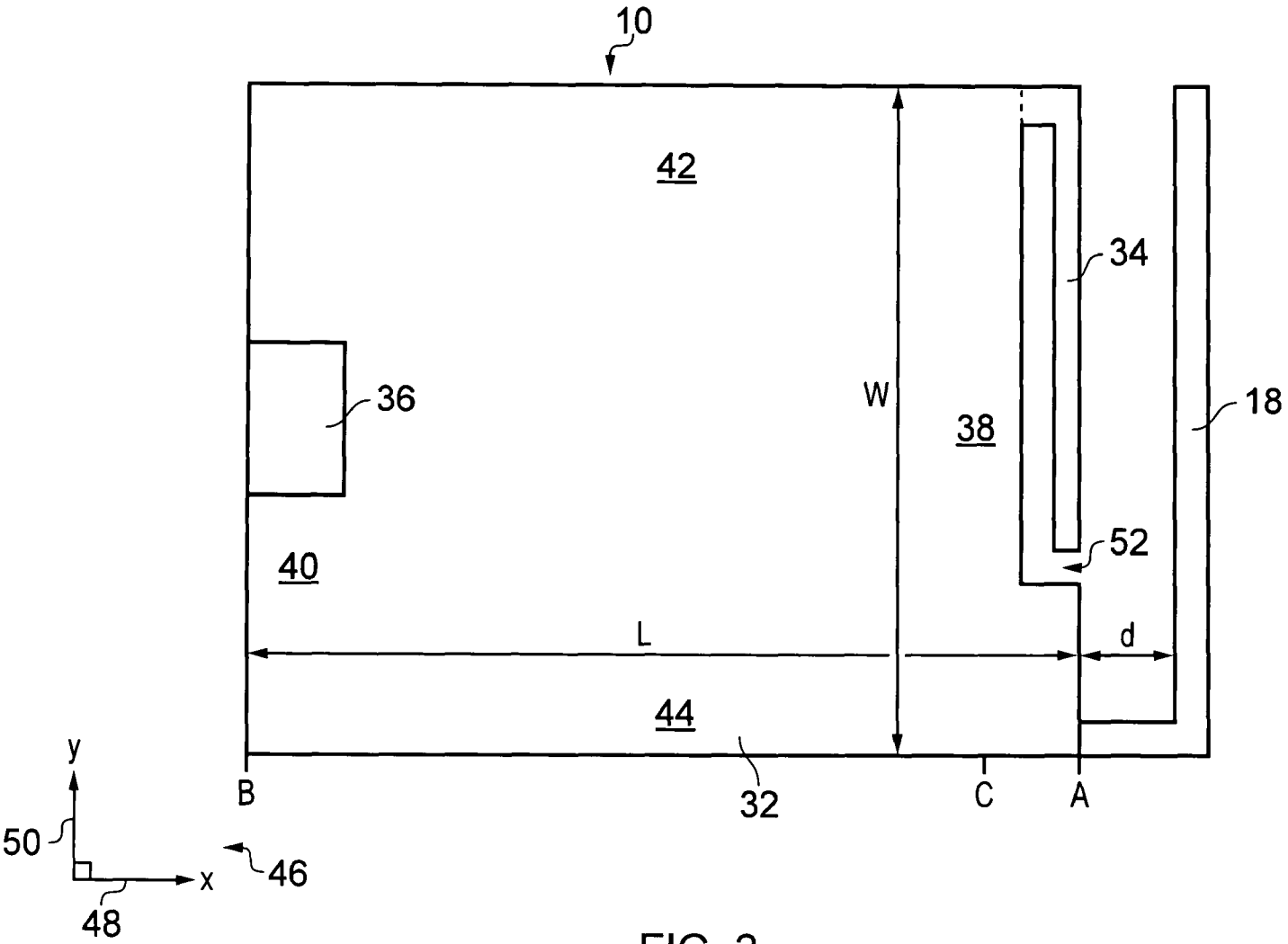
FIG. 2 illustrates a schematic diagram of an apparatus according to various embodiments of the invention.
Figure 2A:
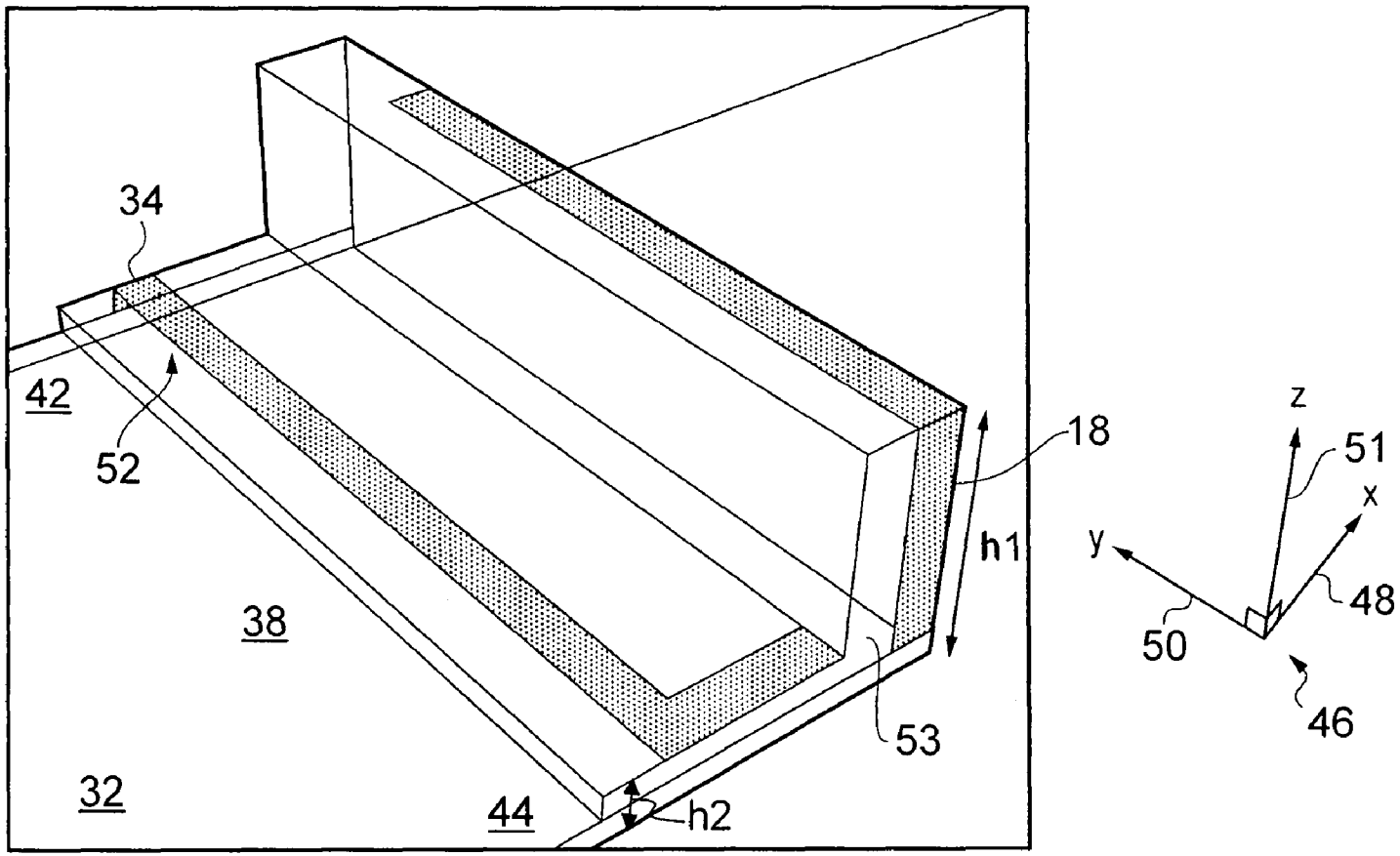
FIG. 2A illustrates a perspective view of another apparatus according to various embodiments of the invention.
Figure 4:
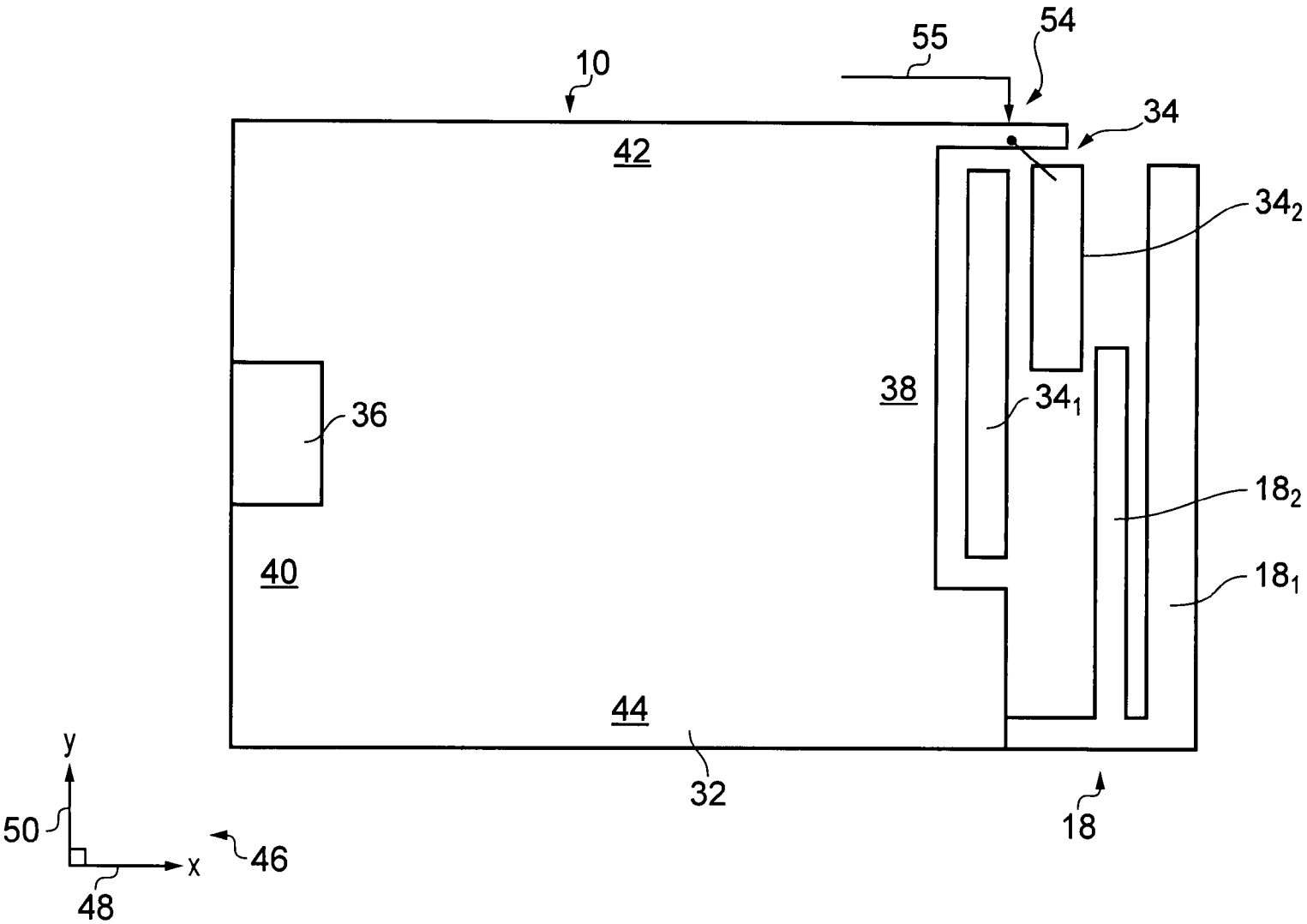
FIG. 4 illustrates a schematic diagram of another apparatus according to various embodiments of the invention.

FIGS. 2, 2A and 4 illustrate an apparatus 10 comprising: a ground plane 32 configured to receive an antenna 18 operable in a first resonant frequency band, at a first end 38 of the ground plane 32; and a member 34 configured to electromagnetically couple with the antenna 18, provide the ground plane 32 with an electrical dimension, in combination with the antenna 18, having a resonant mode at the first resonant frequency band, and to reduce current distribution at a second end 40 of the ground plane 32, different to the first end 38.

Figure 1:
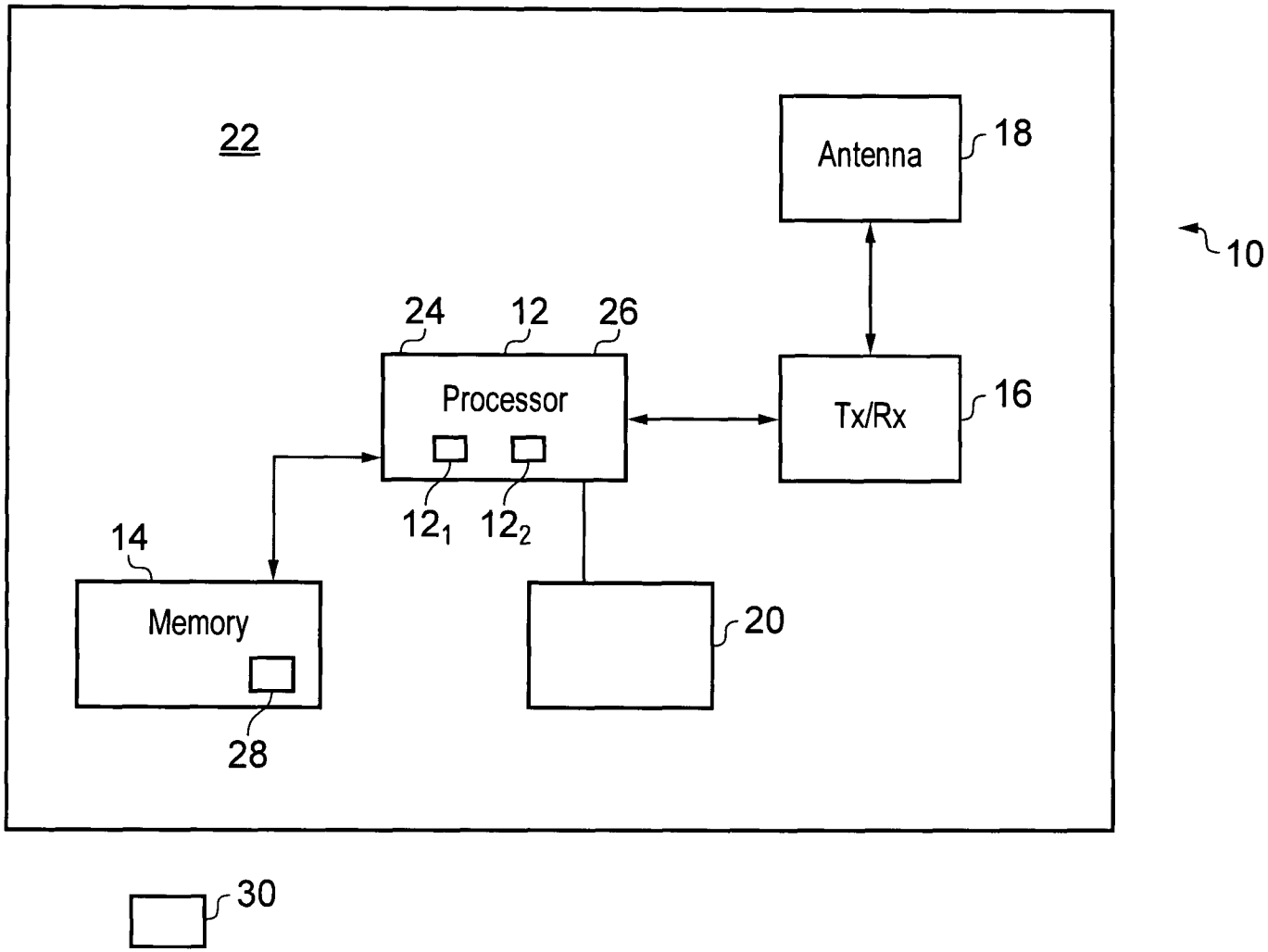
FIG. 1 illustrates a schematic diagram of an apparatus according to various embodiments of the invention.

FIG. 1 illustrates a schematic diagram of an apparatus 10 according to various embodiments of the present invention. The apparatus 10 includes a processor 12, a memory 14, a transceiver 16, an antenna 18, and other circuitry 20.

In the following description, the wording 'connect' and 'couple' and their derivatives mean operationally connected/coupled. It should be appreciated that any number or combination of intervening components can exist (including no intervening elements). Additionally, it should be appreciated that the connection/coupling may be a physical connection and/or an electromagnetic connection.

The apparatus 10 may be any electronic device and may be a portable electronic device such as, for example, a mobile cellular telephone, a personal digital assistant (PDA), a laptop computer, a palm top computer, a portable WLAN or WiFi device, or module for such devices. As used here, 'module' refers to a unit or apparatus that excludes certain parts/components that would be added by an end manufacturer or a user.

In the embodiment where the apparatus 10 is a mobile cellular telephone, the other circuitry 20 includes input/output devices such as a microphone, a loudspeaker, keypad and a display. The electronic components that provide the processor 12, the memory 14, the transceiver 16, the antenna 18 and the other circuitry 20 are interconnected via a printed wiring board (PWB) 22 which may serve as a ground plane for the antenna 18. In various embodiments, the printed wiring board 22 may be a flexible printed wiring board.

The implementation of the processor 12 can be in hardware alone (for example, a circuit etc), have certain aspects in software including firmware alone or can be a combination of hardware and software (including firmware). The processor 12 may be any suitable processor and may include a microprocessor 12, and memory 122. The processor 12 may be implemented using instructions that enable hardware functionality, for example, by using executable computer program instructions in a general-purpose or special-purpose processor that may be stored on a computer readable storage medium (for example, disk, memory etc) to be executed by such a processor.

The processor 12 is configured to read from and write to the memory 14. The processor 12 may also comprise an output interface 24 via which data and/or commands are output by the processor 12 and an input interface 26 via which data and/or commands are input to the processor 12.

The memory 14 may be any suitable memory and may, for example be permanent built-in memory such as flash memory or it may be a removable memory such as a hard disk, secure digital (SD) card or a micro-drive. The memory 14 stores a computer program 28 comprising computer program instructions that control the operation of the apparatus 10 when loaded into the processor 12. The computer program instructions 28 provide the logic and routines that enables the apparatus 10 to perform the method illustrated in FIG. 5. The processor 12 by reading the memory 14 is able to load and execute the computer program 28.

The computer program 28 may arrive at the apparatus 10 via any suitable delivery mechanism 30. The delivery mechanism 30 may be, for example, a computer-readable storage medium, a computer program product, a memory device, a record medium such as a CD-ROM or DVD, an article of manufacture that tangibly embodies the computer program 28. The delivery mechanism may be a signal configured to reliably transfer the computer program 28. The apparatus 10 may propagate or transmit the computer program 28 as a computer data signal.

Although the memory 14 is illustrated as a single component it may be implemented as one or more separate components some or all of which may be integrated/removable and/or may provide permanent/semi-permanent/dynamic/cached storage.

References to 'computer-readable storage medium', 'computer program product', 'tangibly embodied computer program' etc. or a 'controller', 'computer', 'processor' etc. should be understood to encompass not only computers having different architectures such as single/multi-processor architectures and sequential (for example, Von Neumann)/parallel architectures but also specialized circuits such as field-programmable gate arrays (FPGA), application specific circuits (ASIC), signal processing devices and other devices. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

The processor 12 is configured to provide signals to the transceiver 16. The transceiver 16 is configured to receive and encode the signals from the processor 12 and provide them to the antenna 18 for transmission. The transceiver 16 is also operable to receive and decode signals from the antenna 18 and then provide them to the processor 12 for processing.

The antenna 18 may be any antenna which is suitable for operation in an apparatus such as a mobile cellular telephone. For example, the antenna 18 may be a planar inverted F antenna (PIFA), a planar inverted L antenna (PILA), a loop antenna, a monopole antenna or a dipole antenna. The antenna 18 may be a single antenna with one feed, a single antenna with multiple feeds or it may be an antenna arrangement which includes a plurality of antennas (for example, such as any combination of those mentioned above) with a plurality of feeds. The antenna/antenna arrangement 18 may have one or more ground points which are configured to provide the antenna/antenna arrangement 18 with a ground reference.

The antenna 18 may have matching components between one or more feeds and the transceiver 16. These matching components may be lumped components (for example, inductors and capacitors) or transmission lines, or a combination of both. The antenna 18 is operable in at least one operational resonant frequency band and may also be operable in a plurality of different radio frequency bands and/or protocols (for example, GSM, CDMA, and WCDMA).

FIG. 2 illustrates a schematic diagram of an apparatus 10 according to various embodiments of the present invention. The apparatus 10 includes a ground plane 32, a member 34, an audio output 36 and an antenna 18.

The ground plane 32 may be any conductive part of the apparatus 10 and may be, as mentioned above, a printed wiring board that interconnects some, or all, of the electronic components of the apparatus 10. Alternatively, the ground plane 32 may be a conductive casing of a component of the apparatus 10 (for example, the ground plane 32 may be a metallic covering of a battery of the apparatus 10) or be a conductive casing of the apparatus 10 itself (for example, a substantially metallic cover that defines the exterior surface of the apparatus 10). The ground plane 32 may be planar in various embodiments (where it is a printed wiring board for example) or be non-planar (where it is a casing for an electronic component of the apparatus 10 for example). The ground plane 32 may be referred to as a radiator in various embodiments of the present invention.

The ground plane 32 has a rectangular shape and has a first end 38, a second end 40, a third end 42 and a fourth end 44, the edges of which define the perimeter of the ground plane 32. The ground plane 32 has a physical length (L) that extends between the edges of the first and second ends 38, 40 and a physical width (W) that extends between the edges of the third and fourth ends 42, 44. The edge of the first end 38 and the edge of the second end 40 are shorter in length than the edge of the third end 42 and the edge of the fourth end 44. Consequently, the first end 38 is opposite the second end 40 and the third end 42 is opposite the fourth end 44. It should be appreciated that the above geometry is exemplary and that in other embodiments, the ground plane 32 may have any shape and consequently, any number of edges in any arrangement.

FIG. 2 also illustrates a Cartesian co-ordinate system 46 that includes an X axis 48 and a Y axis 50 which are orthogonal relative to one another.

The ground plane 32 is configured to receive the antenna 18 at the first end 38. In particular, the ground plane 32 is configured to receive the antenna 18 at the corner of the ground plane 32 defined by the edge of the first end 38 and the edge of the fourth end 44. The ground plane 32 may also be configured to receive the antenna 18 at another location of the ground plane 32 other than a corner of the ground plane 32. For example, the ground plane 32 may be configured to receive the antenna 18 part way along the edge of the first end 38.

In the above examples, the wording 'configured to receive the antenna' should be understood to encompass embodiments where the ground plane 32 may be specifically adapted to receive the antenna 18 at a feed point provided on the ground plane and other embodiments where the first end 38 is suitable for receiving the antenna 18, but is not specifically adapted to receive the antenna 18.

In this embodiment the antenna 18 is a planar inverted L antenna, operable in a first resonant frequency band (for example, PCS 1900 (1850-1990 MHz)) and has an electrical length substantially equal to $\lambda/4$. The antenna 18 extends from the corner defined by the edge of the first end 38 and the edge of the fourth end 44 in the +X direction and then makes a right angled, left handed turn and then extends in the +Y direction until an end point. The portion of the antenna 18 between the end point and where the antenna 18 extends in the +Y direction is at a distance d from the first edge 38 of the ground plane 32. Consequently, the antenna 18 and the ground plane 32 define an aperture therebetween. In other embodiments, the antenna 18 may be operable in a plurality of resonant frequency bands either having a single radiating element or by having a plurality of radiating elements.

It should be understood that although the above embodiment is substantially planar, the antenna 18 may also (or alternatively) have a height above the ground plane 32 and that this is not illustrated in order to maintain the clarity of the figure.

A material may be provided in the space defined by the antenna 18 and the ground plane 32 which may support the antenna 18. The material may include any non-conductive material, for example, polycarbonate acrylonitrile butadiene styrene (PC-ABS), ceramic, polystyrene, printed wiring board FR4 or any other type of plastic or other non-conductive material usually used for such mechanical structures.

The audio output 36 may be any device which is suitable for providing an audio output to a user. For example, the audio output 36 may be a loudspeaker which is configured to receive signals from the processor 12 and provide them to a user of the apparatus 10 as an audio signal. In this embodiment, the audio output 36 is located at the second end 40 of the ground plane 32. Consequently, when a user is operating the apparatus 10, the audio output device 36 is located at the top of the apparatus and the antenna 18 is located at the bottom of the apparatus.

The member 34 is conductive and may be planar (it may be in the same plane as the ground plane 32 for example) or non-planar. In this embodiment, the member 34 is integral with and part of the ground plane 32 (and consequently in the same plane as ground plane 32). The member 34 can be considered as being defined by a slot 52 that extends from the edge of the first end 38 and has an L shape. In more detail, the slot 52 extends from a position along the edge of the first end 38 which is (in this embodiment) approximately one third along the edge from the corner defined by the edges of the first end 38 and the fourth end 44. The slot 52 extends in the −X direction and then makes a right angled, right handed turn and then extends in the +Y direction until an end point.

The member 34 can also be considered as including a conductive elongate portion (a portion of the ground plane 32) that extends from a corner of the ground plane 32 that is defined by the edges of the first end 38 and the third end 42. The portion extends in the +X direction and then makes a right angled, right handed turn and then extends in the −Y direction until an end point which is at a position which is (in this embodiment) approximately one third along the edge of the first end 38 from the corner defined by the edge of the first end 38 and the edge of the fourth end 44.

In other embodiments, the member 34 may be a physically separate component to the ground plane 32 (a metallic strip for example) which is connectable to the ground plane 32 via soldering for example.

As will be understood from the above description, the member 34 is substantially parallel to the antenna 18. Additionally, the end point (i.e. the open end) of the member 34 is positioned in closer proximity to the feed of the antenna 18 than the interface between the member 34 and the ground plane 32. For example, the distance between the feed of the antenna 18 and the open end of the member 34 may be between ten to twenty five millimetres.

The antenna 18 may be at least seven millimetres from the edge of the first end 38 of the ground plane 32. Therefore, the member 34 is not configured to operate as a 'parasitic element' known in the art, but is instead configured to operate as a microwave element such as a microstrip stub line with a short circuit end and an open circuit end. As will be explained in more detail in the following paragraphs, the member 34 is configured to modify the electrical dimension (length and/or width) of the ground plane 32 and provide a condensed current distribution near the feed point of the antenna 18 and thereby substantially reduce (and substantially eliminate in some embodiments) current distribution at the others ends 40, 42 and 44 of the ground plane 32.

FIG. 2A illustrates a perspective view of another apparatus 10 according to various embodiments of the present invention. The apparatus 10 illustrated in FIG. 2A is similar to the apparatus illustrated in FIG. 2 and where the features are similar, the same reference numerals are used.

FIG. 2A also illustrates a Cartesian co-ordinate system 46 that includes an X axis 48, a Y axis 50 and Z axis 51 which are orthogonal relative to one another.

In this embodiment, the apparatus 10 includes a support member 53 (for example, an antenna carrier) positioned at the first end 38 of the ground plane 32. The support member 53 comprises a first cuboid having a height $h_1$ and a second cuboid having a height $h_2$. The two cuboids are contiguous with one another and the height $h_1$ of the first cuboid is greater than the height $h_2$ of the second cuboid. The antenna 18 is mounted on the first cuboid and the member 34 is mounted on the second cuboid. Consequently, the arrangement illustrated in FIG. 2A is three dimensional. In other embodiments, only the antenna 18 may be mounted on the support member 53, and the member 34 may be mounted on a separate support member (not illustrated). Therefore, the antenna 18 and the member 34 do not necessarily have to be mounted on the same carrier. There may be physical separation, for example a gap, between each of the separate support members.

In more detail, the antenna 18 extends from the corner of the ground plane 32 defined by the edge of the first end 38 and the edge of the fourth end 44 in a +Z direction. The antenna 18 then makes a right angled turn at height $h_1$ above the ground plane 32 and extends in the +Y direction until an end point.

The member 34 is conductive and may be planar or non-planar. In this embodiment, the member is configured to connect to the ground plane 32. The member 34 extends from the edge of the third end 42 (near the corner defined by the first end 38 and the third end 42) in the +Z direction and then makes a right angled turn at the height $h_2$ above the ground plane 32 and extends in the −Y direction until it reaches the fourth end 44' of the ground plane 32. The member 34 then makes a right angled turn in the +X direction and extends until ah end point (i.e. the open end of the member 34) that is in relatively close proximity to the feed of the antenna 18. Consequently, the member 34 defines a slot 52 that extends from the edge of the second end 42 and has a rectangular shape formed between the member 34 and the ground plane 32.

It should be appreciated that the support member 53 may have any other shape that is suitable for supporting the antenna 18 and the member 34. Additionally, the upper surface(s) of the support member 53 may not be parallel to the ground plane 32.

The support member 53 may comprise any non-conductive material, for example, PC-ABS, plastic, plastic and air, polystyrene etc. The support member 53 may also physically support a flexi-circuit on which the member 34 and the antenna 18 may be provided. Alternatively, the antenna 18 and the member 34 may be constructed from sheet metal which is bent, or other similar manufacturing techniques.

When the antenna 18 is in operation, the antenna 18, ground plane 32 and member 34 provide a radiative combination which is operable to transmit and/or receive electromagnetic signals in the first resonant frequency band. The member 34 is configured to provide the ground plane 32 with an electrical dimension (electrical width in this embodiment) that, in combination with the electrical length of the antenna 18, is equal to $N\lambda/2$ (where N is an integer equal to or greater than 1).

For example, the physical width of the ground plane 32 may be equal to $0.4\lambda$ and the antenna 18 may have an electrical length equal to $0.25\lambda$. In this example, the member 34 is configured to have an electrical length of approximately $0.35\lambda$ and thereby provide the combination of the antenna 18, ground plane 32 and the member 34 with an electrical width of 1.0λ. From this example, it can be seen that the member 34 is configured to change the electrical width of the ground plane 32, member 34 and antenna 18 combination to be equal to a desired value.

The combined electrical width of the ground plane 32, member 34 and antenna 18 is configured to enable current flowing in the ground plane 32, member 34 and antenna 18 to form a standing wave and thereby provide a resonant mode at the first resonant frequency band. In this embodiment, the combined electrical width provides a transverse standing wave that extends between the third end 42 and the fourth end 44 (i.e. along the width of the ground plane 32). The electrical width of the ground plane 32, member 34 and antenna 18 combination is thereby optimised for enabling the current to form a transverse standing wave at the first resonant frequency band. This configuration results in an increase in transverse current flow (i.e. a flow of current along the width of the ground plane 32) and a consequent decrease in longitudinal current flow (i.e. a flow of current along the length of the ground plane 32).

Since the antenna 18 is positioned at the first end 38 of the ground plane 32, the antenna 18 strongly electromagnetically couples with the first end 38 of the ground plane 32 and with the member 34. This configuration results in an increase of current distribution at the first end 38 and a consequent decrease in current distribution at the second end 40. The current distribution at the first end 38 of the ground plane 32 may also be increased by the transverse orientation of the member 34 and by the adjacent and parallel positioning of the member 34 relative to the antenna 18.

Figure 3:
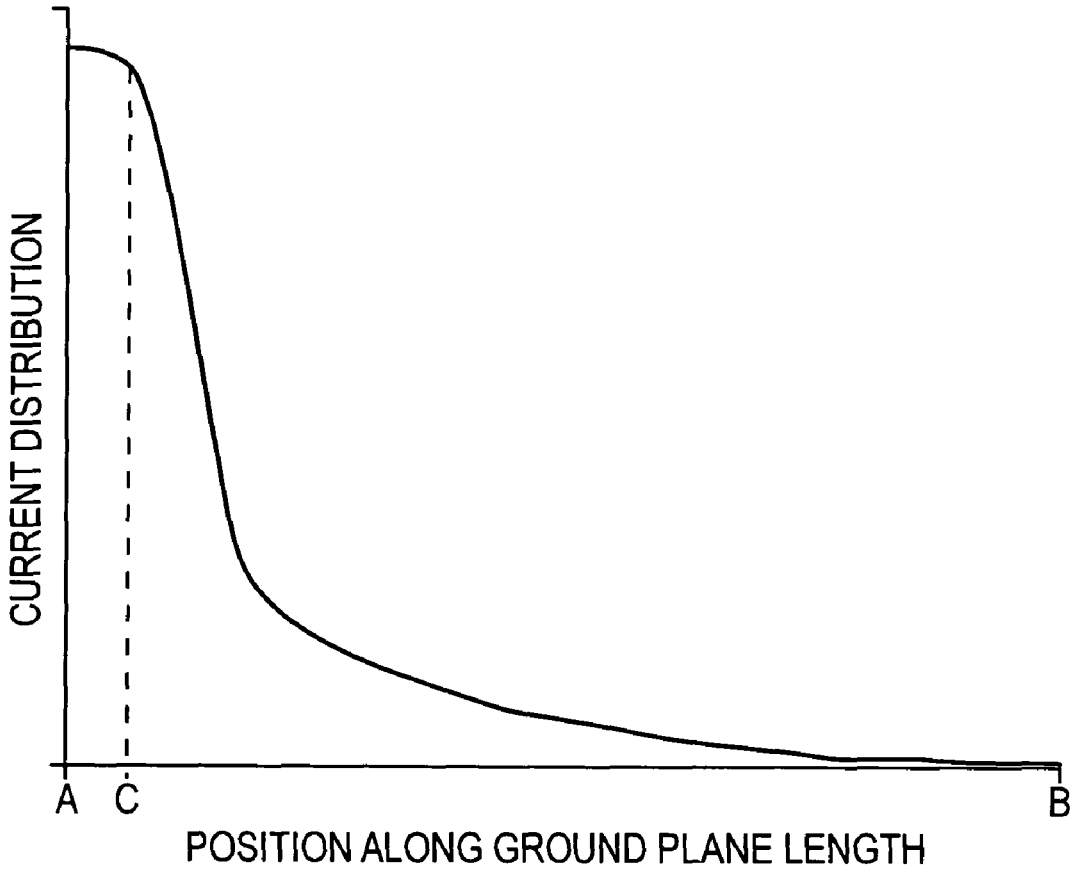
FIG. 3 illustrates a graph of current distribution versus position along a ground plane for the apparatus illustrated in FIG. 2.

FIG. 3 illustrates a graph of current distribution in the ground plane 32 along the length of the ground plane 32. The graph has a horizontal axis that represents the position along the length of the ground plane 32 between position A (first end 38) and position B (second end 40), and a vertical axis that represents the magnitude of the current distribution in the ground plane 32.

At Position A, the magnitude of the current distribution is at a maximum and is substantially constant until position C (corresponding to the interface between the ground plane 32 and the member 34). From position C, the current distribution falls exponentially, reaching a minimum at position B.

Embodiments of the present invention may provide an advantage when the audio output 36 is positioned at the second end 40 of the ground plane 32. The configuration of the ground plane 32, member 34 and antenna 18 may reduce the electromagnetic field at the second end 40 (i.e. the 'near field' at the second end 40) which may reduce interference with a user's hearing aid when a user places the audio output 36 to his ear.

The antenna 18, ground plane 32 and member 34 may be configured to operate in any of the following operational radio frequency bands and via any of the following different protocols. For example, the different frequency bands and protocols may include (but are not limited to) LTE 700 (US) (698.0-716.0 MHz, 728.0-746.0 MHz), LTE 1500 (Japan) (1427.9-1452.9 MHz, 1475.9-1500.9 MHz), LTE 2600 (Europe) (2500-2570 MHz, 2620-2690 MHz), AM radio (0.535-1.705 MHz); FM radio (76-108 MHz); Bluetooth (2400-2483.5 MHz); WLAN (2400-2483.5 MHz); HLAN (5150-5850 MHz); GPS (1570.42-1580.42 MHz); US-GSM 850 (824-894 MHz); EGSM 900 (880-960 MHz); EU-WCDMA 900 (880-960 MHz); PCN/DCS 1800 (1710-1880 MHz); US-WCDMA 1900 (1850-1990 MHz); WCDMA 2100 (Tx: 1920-1980 MHz Rx: 2110-2180 MHz); PCS1900 (1850-1990 MHz); UWB Lower (3100-4900 MHz); UWB Upper (6000-10600 MHz); DVB-H (470-702 MHz); DVB-H US (1670-1675 MHz); DRM (0.15-30 MHz); Wi Max (2300-2400 MHz, 2305-2360 MHz, 2496-2690 MHz, 3300-3400 MHz, 3400-3800 MHz, 5250-5875 MHz); DAB (174.928-239.2 MHz, 1452.96-1490.62 MHz); RFID LF (0.125-0.134 MHz); RFID HF (13.56-13.56 MHz); RFID UHF (433 MHz, 865-956 MHz, 2450 MHz). An operational frequency band is a frequency range over which an antenna can efficiently operate. Efficient operation occurs, for example, when the antenna's insertion loss S11 is greater than an operational threshold such as 4 dB or 6 dB.

It should be appreciated that the member 34 may have any shape which is suitable for providing the combination of the ground plane 32, member 34 and antenna 18 with an electrical dimension that reduces the current distribution as described above. Furthermore, the member 34 may include one or more reactive components (for example, capacitors, inductors) that electrically lengthen or shorten the electrical length of the member 34 as desired.

In the above embodiment, the member 34 is configured to provide the ground plane 32 and antenna 18 combination with a particular electrical width. It should be appreciated however that the member 34 may be configured to provide the ground plane 32 and antenna 18 combinations with any particular electrical dimension. For example, if the audio output 36 is positioned at the fourth end 44, then in order to reduce current distribution at the fourth end 44, the antenna 18 and the member 34 may be positioned at the third end 42 and the member 34 may be configured to provide the combination of the ground plane 32 and the antenna 18 with a particular electrical length.

It should be understood that embodiments of the present invention may include other physical configurations of the member 34, antenna 18 and audio output 36. For example, the audio output 36 may be positioned at the fourth end 44 and the antenna 18 may be positioned at the first end 38. In this example, the antenna 18 has at least one feed point to the ground plane 32 located at the corner defined by the edge of the first end 38 and the edge of the third end 42. The member 34 is located along the edge 42 and is configured so that the open end of the member 34 is positioned in relatively close proximity with at least one feed point of the antenna 18. In this example, the member 34 is configured to modify the current distribution so that it is substantially condensed along the edge of the third end 42 and substantially reduced (substantially eliminated in some embodiments) at the fourth end 44.

In various embodiments, a 'common mode' of the antenna 18 and the member 34 may be used to provide an additional resonant frequency band in which the apparatus 10 is operable. In more detail, the antenna 18, ground plane 32 and member 34 may provide a radiative combination which is operable to efficiently transmit and/or receive electromagnetic signals in a second resonant frequency band (different to the first resonant frequency band mentioned above). The member 34 is configured to provide the ground plane 32 with an electrical dimension (electrical length in the embodiment described in the preceding paragraphs) that, in combination with the electrical length of the antenna 18, is equal to $N\lambda/2$ (where N is an integer equal to or greater than 1).

The combined electrical length provides a longitudinal standing wave that extends between the first end 38 and the second end 40 (i.e. along the length of the ground plane 32). The electrical length of the ground plane 32, member 34 and antenna 18 combination is thereby optimised for enabling the current to form a longitudinal standing wave at the second resonant frequency band.

FIG. 4 illustrates a schematic diagram of another apparatus 10 according to various embodiments of the present invention. The apparatus 10 illustrated in FIG. 4 is similar to the apparatus illustrated in FIG. 2 and where the features are similar, the same reference numerals are used. The apparatus 10 illustrated in FIG. 4 differs from that illustrated in FIG. 2 in that the antenna 18 includes a first portion $\mathbf{18}_1$, operable in a first resonant frequency band (for example, EGSM 900 (880-960 MHz)) and a second portion $\mathbf{18}_2$, operable in a second resonant frequency band (for example, PCS 1900 (1850-1990 MHz)).

In this embodiment, the member 34 is variable and is configured to provide the ground plane 32 with an electrical dimension, in combination with the antenna 18, selectable from a plurality of electrical dimensions. In the illustrated embodiment, the member 34 includes a first portion $\mathbf{34}_1$ and a second portion $\mathbf{34}_2$ which are selectively connectable to the ground plane 32 via a switch 54. The switch 54 is configured to receive control signals 55 from the processor 12 (illustrated in FIG. 1) and switch between connecting the ground plane 32 to the first portion $\mathbf{34}_1$ and connecting the ground plane 32 to the second portion $\mathbf{34}_2$.

The first portion $\mathbf{34}_1$ is configured to provide the combination of the ground plane 32, first antenna portion $\mathbf{18}_1$ with an electrical width at the first resonant frequency band which reduces current distribution at the second end 40 as described above with reference to FIG. 2. The second portion $\mathbf{34}_2$ is configured to provide the combination of the ground plane 32, second antenna portion $\mathbf{18}_2$ with an electrical width at the second resonant frequency band which reduces current distribution at the second end 40.

The first portion $\mathbf{34}_1$ of the member 34 may be located at a different end of the ground plane 32 to the second portion $\mathbf{34}_2$ of the member 34 in order to take account of the different current distributions provided by the different operating frequency bands of the antenna 18. For example, where the antenna 18 is located at the first end 38, the first portion $\mathbf{34}_1$ may be located at the first end 38 and the second portion $\mathbf{34}_2$ may be located at the third end 42.

In other embodiments of the invention, the member 34 may include a plurality of reactive components (for example, inductors and capacitors) and a switch for connecting them to the ground plane 32 to change the electrical dimension of the combination 32, 34, 18.

The operation of the apparatus 10 illustrated in FIG. 4 will now be explained with reference to the flow diagram illustrated in FIG. 5. At block 56, the processor 12 determines if the electrical dimension of the ground plane 32, antenna 18 and member 34 combination should be changed. For example, the apparatus 10 may determine that the electrical dimension of the combination 32, 34, 18 should be changed if the operational frequency band of the apparatus 10 changes from the first operational frequency band to the second operational frequency band and vice versa.

When the processor 12 determines that the electrical dimension of the combination 32, 34, 18 should not be changed (block 58), the method moves back to block 56 and the processor continues to determine whether the electrical dimension 32, 34, 18 should be changed.

When the processor 12 determines that the electrical dimension of the combination 32, 34, 18 should be changed, the method moves to block 60 and the processor 12 sends a control signal 55 to the switch 54 to connect the ground plane 32 to either the first portion $\mathbf{34}_1$ of the member 34 or to the second portion $\mathbf{34}_2$ of the member 34 as desired. Once the electrical dimension 34, 32, 18 has been varied, the method moves back to block 56 and the processor 12 continues to determine if the electrical dimension should be varied.

Figure 5:
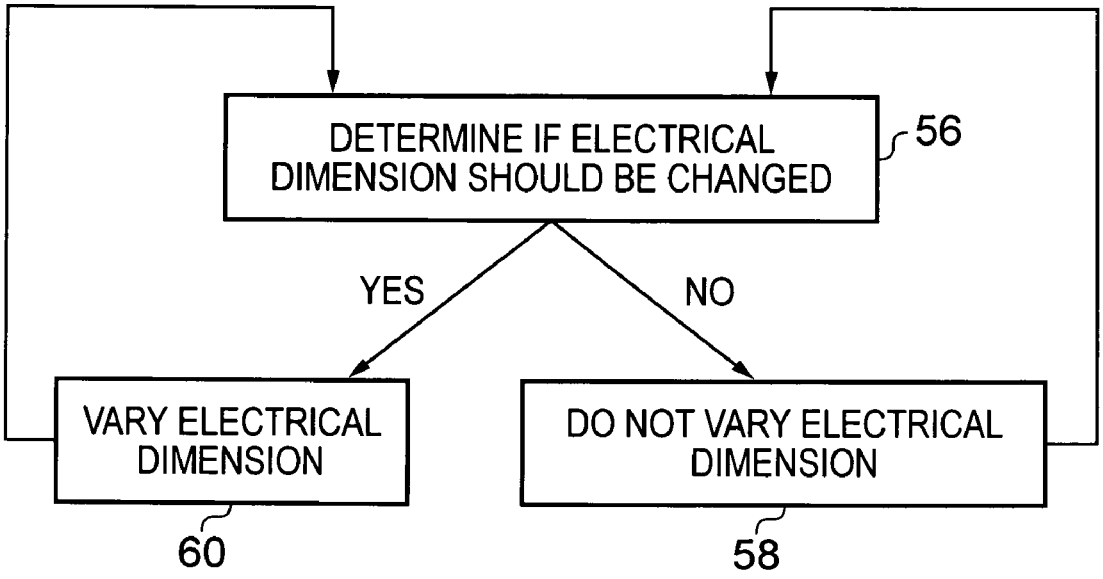
FIG. 5 illustrates a flow diagram of a method of controlling an electrical dimension according to various embodiments of the present invention.

The blocks illustrated in FIG. 5 may represent steps in a method and/or sections of code in the computer program 28. The illustration of a particular order to the blocks does not necessarily imply that there is a required or preferred order for the blocks and the order and arrangement of the blocks may be varied. Furthermore, it may be possible for some steps to be omitted.

Figure 6:
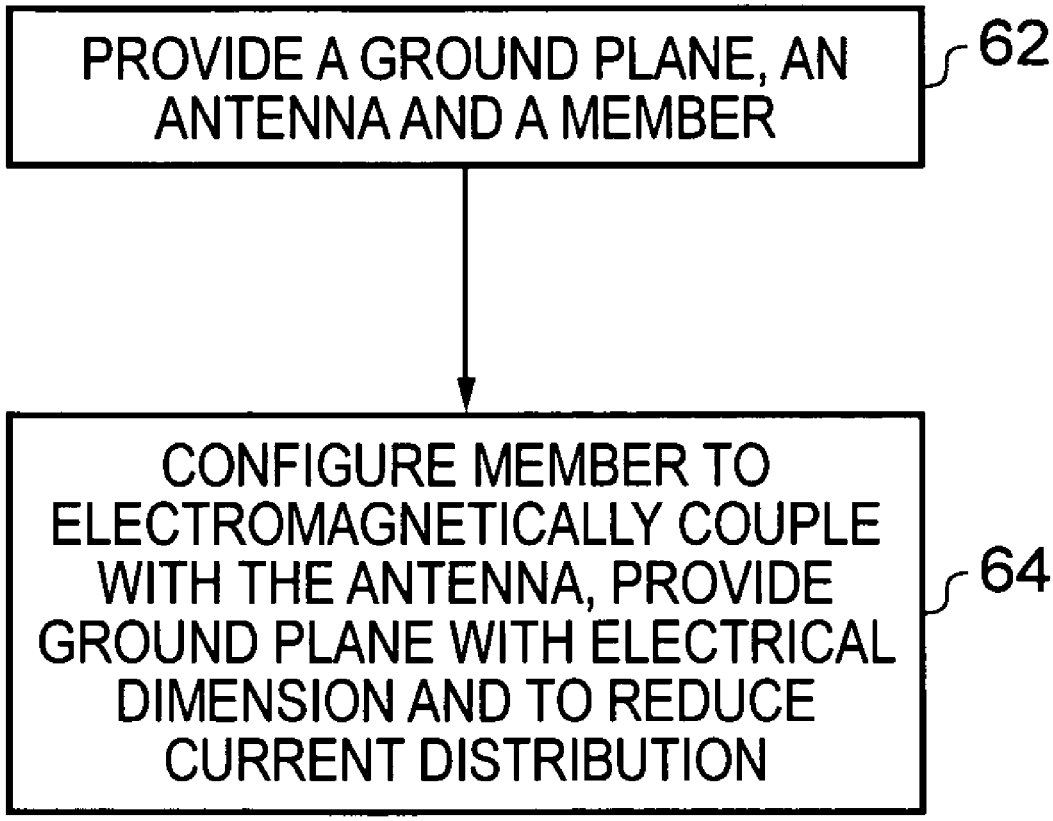
FIG. 6 illustrates a flow diagram of a method of providing an apparatus according to various embodiments of the present invention.

FIG. 6 illustrates a flow diagram of a method of providing an apparatus according to various embodiments of the present invention. At block 62, the method includes providing a ground plane 32, an antenna 18 and a member 34. At block 64, the method includes configuring the member 34 to electromagnetically couple with the antenna 18, provide the ground plane 32 with an electrical dimension having a resonant mode at the first resonant frequency band and to reduce the current distribution at the second end 40 of the ground plane 32. Block 64 may also include configuring the member 34 to be variable and to provide the ground plane 32 with an electrical dimension in combination with the antenna 18 that is selectable from a plurality of electrical dimensions.

Although embodiments of the present invention have been described in the preceding paragraphs with reference to various examples, it should be appreciated that modifications to the examples given can be made without departing from the scope of the invention as claimed. For example, embodiments of the present invention may find application in reducing electromagnetic interference between two different antennas within an apparatus. In this example, a first antenna may be positioned at the first end 38 of the ground plane 32 and a second antenna may be positioned at the second end 40 of the ground plane 32. In this example, embodiments of the present invention may reduce the near field of the first antenna at the second end 40 and may reduce the near field of the second antenna at the first end 38.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. An apparatus comprising:

a ground plane configured to receive an antenna operable in a first resonant frequency band, at a first end of the ground plane;

a member configured to electromagnetically couple with the antenna, provide the ground plane with an electrical dimension, in combination with the antenna, having a resonant mode at the first resonant frequency band, and to reduce current distribution at a second end of the ground plane, different to the first end; and an audio output positioned at the second end of the ground plane and configured to provide audio signals to a user of the apparatus.

2. An apparatus as claimed in claim 1, wherein the member is positioned at the first end of the ground plane.

3. An apparatus as claimed in claim 1, wherein the member is integral with the ground plane.

4. An apparatus as claimed in claim 1, wherein the member is configured to connect to the ground plane.

5. An apparatus as claimed in claim 1, wherein the first end of the ground plane is opposite to the second end of the ground plane.

6. An apparatus as claimed in claim 1, wherein the member comprises an elongate conductive portion that is configured to extend from the ground plane toward a feed point of the antenna.

7. An apparatus as claimed in claim 6, wherein an open end of the elongate conductive portion is configured to be in relatively close proximity to the feed point of the antenna.

8. An apparatus as claimed in claim 1, wherein the member is configured to be substantially parallel to the antenna.

9. An apparatus as claimed in claim 1, wherein the member is configured to be variable and to provide the ground plane with an electrical dimension, in combination with the antenna, selectable from a plurality of electrical dimensions.

10. An apparatus as claimed in claim 9, further comprising a processor configured to control the member and to select the electrical dimension of the ground plane.

11. An apparatus as claimed in claim 1, wherein the member is configured to provide the ground plane with another electrical dimension, in combination with the antenna, having a resonant mode at a second resonant frequency band, different to the first resonant frequency band.

12. A portable electronic device comprising an apparatus as claimed in claim 1.

13. A module comprising an apparatus as claimed in claim 1.

14. A method comprising:

providing a ground plane configured to receive an antenna operable in a first resonant frequency band, at a first end of the ground plane, and a member;

configuring the member to electromagnetically couple with the antenna, provide the ground plane with an electrical dimension, in combination with the antenna, having a resonant mode at the first resonant frequency band, and to reduce current distribution at a second end of the ground plane, different to the first end; and providing an audio output positioned at the second end of the ground plane and configuring the audio output to provide audio signals to a user of the apparatus.

15. A method as claimed in claim 14, further comprising positioning the member at the first end of the ground plane.

16. A method as claimed in claim 14, wherein the first end of the ground plane is opposite to the second end of the ground plane.

17. A method as claimed in claim 14, wherein the member comprises an elongate conductive portion, and the method includes configuring the elongate conductive portion to extend from the ground plane toward a feed point of the antenna.

18. A method as claimed in claim 17, further comprising configuring an open end of the elongate conductive portion to be in close proximity to the feed point of the antenna.

19. A method as claimed in claim 14, further comprising configuring the member to be substantially parallel to the antenna.

20. A method as claimed in claim 14, further comprising configuring the member to be variable and to provide the ground plane with an electrical dimension, in combination with the antenna, selectable from a plurality of electrical dimensions.

21. A method as claimed in claim 20, further comprising providing a processor and configuring the processor to control the member and to select the electrical dimension of the ground plane.

22. A method as claimed in claim 14, further comprising configuring the member to provide the ground plane with another electrical dimension, in combination with the antenna, having a resonant mode at a second resonant frequency band, different to the first resonant frequency band.

23. A computer program that, when run on a computer, performs:

controlling a member to provide a ground plane, in combination with an antenna, with an electrical dimension, selectable from a plurality of electrical dimensions, having a resonant mode at a first resonant frequency band, and to reduce current distribution at a second end of the ground plane, wherein the member is configured to electromagnetically couple with the antenna and the antenna is positioned at a first end of the ground plane, different to the second end of the ground plane and is operable in the first resonant frequency band, and wherein an audio output is positioned at the second end of the ground plane and is configured to provide audio signals to a user of the apparatus.

24. A computer program as claimed in claim 23, that when run on a computer further performs determining if a change in the electrical dimension of the ground plane, member, and antenna combination is required, and controlling the member if a change in the electrical dimension is required.

25. A computer readable storage medium encoded with instructions that, when executed by a processor, performs:

controlling a member to provide a ground plane, in combination with an antenna, with an electrical dimension, selectable from a plurality of electrical dimensions, having a resonant mode at a first resonant frequency band, and to reduce current distribution at a second end of the ground plane, wherein the member is configured to electromagnetically couple with the antenna and the antenna is positioned at first end of the ground plane, different to the second end of the ground plane and is operable in the first resonant frequency band, and wherein an audio output is positioned at the second end of the ground plane and is configured to provide audio signals to a user of the apparatus.

26. A computer readable storage medium as claimed in claim 25, encoded with instructions that, when executed by a processor, further performs:

determining if a change in the electrical dimension of the ground plane, member, and antenna combination is required, and controlling the member if a change in the electrical dimension is required.

27. A method comprising:

controlling a member to provide a ground plane, in combination with an antenna, with an electrical dimension, selectable from a plurality of electrical dimensions, having a resonant mode at a first resonant frequency band, and to reduce current distribution at a second end of the ground plane, wherein the member is configured to electromagnetically couple with the antenna and the antenna is positioned at first end of the ground plane, different to the second end of the ground plane and is operable in the first resonant frequency band, and wherein an audio output is positioned at the second end of the ground plane and is configured to provide audio signals to a user of the apparatus.

28. A method as claimed in claim 27, further comprising:

determining if a change in the electrical dimension of the ground plane, member, and antenna combination is required, and controlling the member if a change in the electrical dimension is required.

* * * * *